United States Patent [19]

Fitzmayer et al.

[11] 4,378,485

[45] Mar. 29, 1983

[54] ELECTRIC HEATING UNIT HAVING NOISE ISOLATION MEANS FOR CONVOLUTED SHEATHED ELECTRIC HEATER

[75] Inventors: Louis H. Fitzmayer; Joseph M. Connelly, both of Louisville, Ky.

[73] Assignee: General Electric Company, Louisville, Ky.

[21] Appl. No.: 344,852

[22] Filed: Feb. 1, 1982

[51] Int. Cl.[3] ..... H05B 3/68

[52] U.S. Cl. ..... 219/463; 174/42; 165/69; 219/455; 219/460; 219/467; 219/536; 248/68 R; 219/542

[58] Field of Search ..... 219/447, 451, 455, 456, 219/460, 463, 467, 532, 536, 538, 542; 174/42, 146, 147; 310/92, 183; 165/69, 84; 248/68 R, 68 CB, 562

[56] References Cited

U.S. PATENT DOCUMENTS

| | | | |
|---|---|---|---|
| 2,271,977 | 2/1942 | Hjelmgren | 219/463 X |
| 2,467,348 | 4/1949 | Tuttle | 219/463 |
| 2,515,579 | 7/1950 | Allen | 219/455 |
| 2,662,158 | 12/1953 | Vallorani et al. | 219/461 X |
| 2,943,178 | 6/1960 | Aldous | 219/463 |
| 3,016,444 | 1/1962 | Jasionowski | 219/451 |
| 3,021,414 | 2/1962 | Sand | 219/451 |
| 3,121,467 | 2/1964 | Bryant | 165/69 X |
| 3,188,449 | 6/1965 | Hanson | 219/455 |
| 3,258,580 | 6/1965 | Dills | 219/463 |
| 3,327,966 | 6/1967 | Jasionowski | 248/205 |
| 3,345,498 | 10/1967 | Sieglo | 219/464 |
| 3,348,025 | 10/1967 | Bassett, Jr. et al. | 219/467 |
| 3,910,537 | 10/1975 | Laboue et al. | 248/68 CB |

*Primary Examiner*—Volodymyr Y. Mayewsky

*Attorney, Agent, or Firm*—F. P. Giacalone; R. M. Reams

[57] ABSTRACT

This invention relates to electric heaters of the type consisting of a flat convoluted loop or coil adapted to be arranged in an opening in a cooktop and, more particularly, to a support system wherein means are provided for cushioning vibrations resulting from relative movement between the convoluted heater and the support system.

5 Claims, 3 Drawing Figures

ELECTRIC HEATING UNIT HAVING NOISE ISOLATION MEANS FOR CONVOLUTED SHEATHED ELECTRIC HEATER

CROSS REFERENCE TO RELATED APPLICATION

This application is related to concurrently filed application Ser. No. 344,854, filed in the name of James A. Dooley and assigned to General Electric Company, the assignee of the present invention.

BACKGROUND OF THE INVENTION

Sheathed heating units of the type arranged in flat convoluted loops or coils are generally arranged on a support grid consisting of a plurality of radially disposed support arms. In some prior art units, each convolution of the heating coil has been anchored to each support arm. This is usually accomplished by means of upwardly extending pairs of tabs that are formed on the support arms. Each convolution of the heater is positioned between the tabs which grip the sheath of the heating element. This method of securing the heating coil does provide a unit that is free from vibration noises; however, it does not permit movement of the sheathed heater relative to the support grid as they expand and contract with temperature changes. This lack of movement between the suppot arms and heater creates stresses that can ultimately lead to heating unit failure. Further, this method also results in a relatively large amount of heat dissipation through the grip support structure and also results in distortions at each point of anchor between the heater and support arms that can lead to premature failure of the sheathed heating unit.

In other prior art units, the convoluted coil is secured to the support grid at selected locations. For example, in some instances, only the outer pass or convolution of the heating element is anchored to one of the support arms. Except for this single point of attachment of the heating element to the support grid, the convolutions of the heating element are free to move on the upper edges of the supporting grid as they expand and contract with temperature changes. While this arrangement solves the problem relating to heat dissipation through the support assembly, it does however result in noise created by vibrations between the sheathed heating unit and the support structure. These vibrations and, more particularly the resulting noise, are objectionable.

The combination of relatively thin vertical spider or arm members for supporting the heating element together with staking the heating unit at only one location of one arm presents a minimum heat sink potential and, accordingly, a relatively efficient heating unit. However, the unsupported heating element results in some objectionable noise levels generally caused by vibrations between the heating unit and the spider arms.

Accordingly, it is an object of the present invention to provide a sheathed heating unit that is efficient in operation and relatively free from noise caused by vibration between the heating coil and support structure.

SUMMARY OF THE INVENTION

The present invention relates to an electric cooktop heating unit assembly of the type employing a convoluted sheathed heating element. The sheathed heating element is arranged on a support frame including a plurality of support arms extending generally radially that are in turn supported in a reflector pan. The pan includes a flange that engages the cooktop to support the assembly. The support arms are generally thin members arranged vertically on edge with the outer edge portions of each arm supported in the pan. The sheathed heating element is supported on the upper edge portion of the support arms in a single plane. One pass of the convoluted sheathed heating element is secured to one arm of the support frame. A resilient thermal insulating pad means is positioned on the upper edge portion of the support arms so as to be interposed between contact point of each pass of the convoluted sheathed heating element and its associated support arm. A second resilient thermal insulating pad means is positioned between the outer edge portion of each arm and the support pan with a third resilient thermal insulating pad means positioned between the flange and the cooktop. The arrangement effectively cushions vibrations and thermally insulates the sheathed heater element from the support frame.

DESCRIPTION OF THE PREFERRED EMBODIMENT

Figure 1:
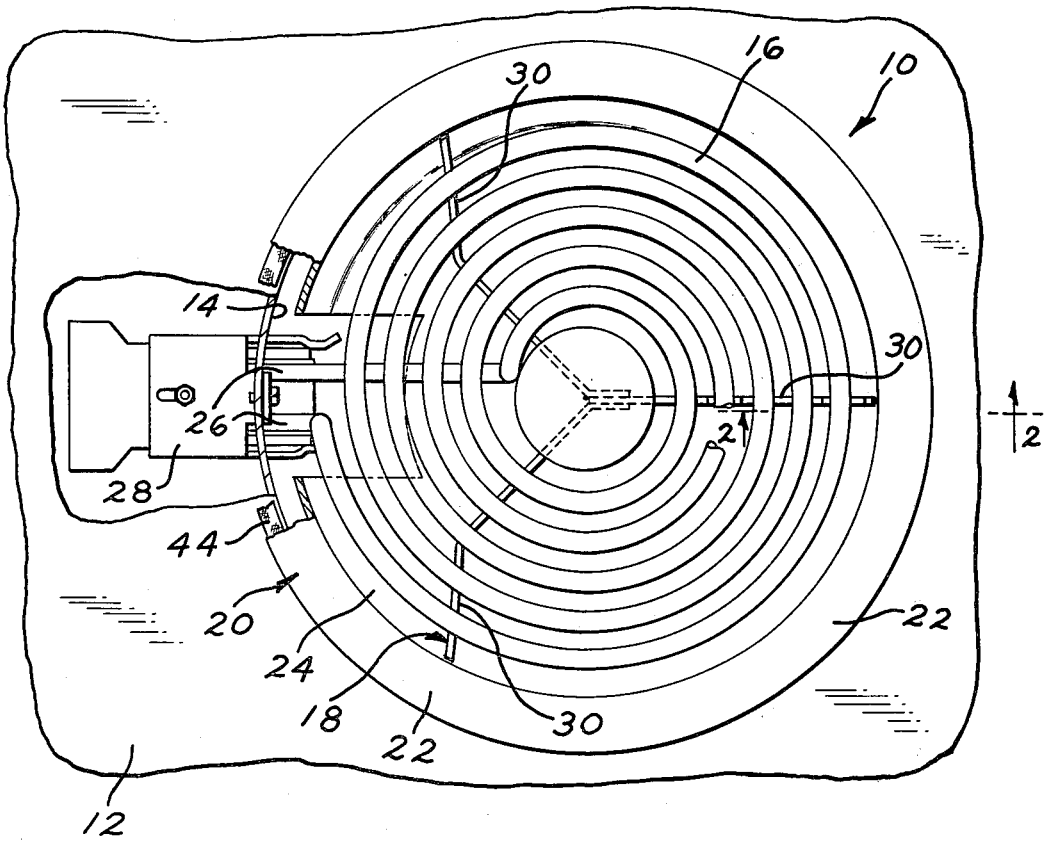
FIG. 1 is a top plan view of a surface heating unit embodying the present invention.
Figure 2:
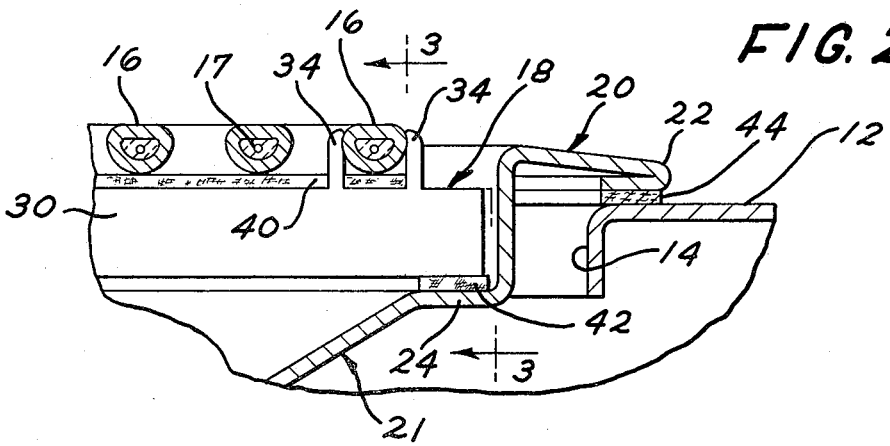
FIG. 2 is a fragmentary elevational view taken along line 2—2 of FIG. 1.
Figure 3:
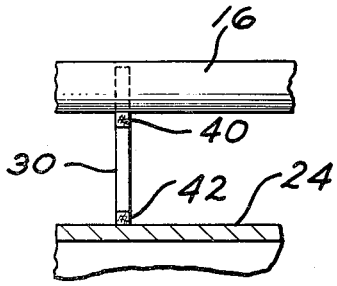
FIG. 3 is a fragmentary elevational view taken along line 3—3 of FIG. 2.

Referring to FIGS. 1 and 2 of the drawings, there is shown a heating unit assembly 10 adapted to be arranged in a top surface 12 of a cooking range. The surface 12 includes a circular opening 14 within which is supported the heating unit assembly 10 embodying the present invention. The heating unit assembly 10 includes three main elements; namely, the metal sheathed heating element 16 that is wound into a flat coil or series of convolutions, an underlying supporting framework or grid 18, and a drip or reflector pan 20 which, as will be explained, is associated with the grid 18 for supporting grid 18 and assembly 10 from the edge of the circulwar opening 14 in the cooktop surface 12. The convoluted heating element 16 is of standard construction in that it has a central resistance element 17 (FIG. 2) arranged longitudinally and surrounded by a suitable electrical insulating material.

The grid support pan 20 is of a rather deep configuration and includes a body portion 21 dimensioned to be positioned in the opening 14 beneath the heating element 16 and its supporting grid 18. The upper perimeter of the reflector pan is formed to provide an outwardly extending support ring portion 22 which engages the surface 12 to support the heating unit assembly 10. Also formed in the body portion 21 of the pan 20 below the ring portion 22 is a ledge portion 24 that extends inwardly relative to ring 22.

The coiled heating element 16 is provided with a pair of parallel terminal end portions 26 extending radially from one side of the center of the coil and from one side of the outer pass of the coil. The portions 26 are not heated during operation of the heating element 16 and are secured within a terminal block 28.

The grid 18 in the present embodiment of the invention is formed to provide three diverging strip-like grid arms or members 30. The outer or radially disposed ends of the arms 30 are arranged on the ledge 24 as shown in FIG. 2. The arms 30 are positioned vertically within the pan 20. The outer or distal ends of the arms 30 are spaced generally 120° to each other. The convoluted turns of the heating element 16 as shown are mounted in a single plane on the upper edges of the grid arms 30. At least one pass of, or convolution of heating element 16 passing over one of the arms 30 is secured thereto. To this end, the upper edge of one of the arms 30 as shown in FIG. 2 is formed to provide a pair of spaced lugs 34 between which the outer pass of heating element 16 is arranged. The lugs 34 are pressed over or toward each other so as to hold the heating element 16 relative to its associated arm 30 of the grid frame 18 through this single point.

The mounting between the heating element 16 and the grid arms 30 are usually in the form of a member similar to lugs 34 clamped or welded to the sheath of the heating element 16. Each point of contact between the heaer 16 and the supporting grid 18 results in heat dissipating from the heater to the support frame leading to loss of efficiency. Further, in practice, it has been found that such connections may damage the sheath during use such that, for example, the clamping element may bite into or rub on the sheath or, if a weld is employed it may tend to pull loose from the sheath and possibly rupture the sheath. In the present embodiment, the likelihood of heater sheath damage or loss of efficiency is diminished by having only one point in which the heating element 16 is secured to the spider. While this method of securing the heater to the grid at only one location minimizes damage and loss of heater efficiency, it does have the disadvantage in that vibrations result between the points of contact between the unattached convolutions of the heater and grid arms which lead to noise levels that are undesirable. The noise producing vibrations are generally transmitted through the range which start as low frequency vibrations and manifest themselves as long duration high frequency vibrations between the heater 16 and support arms 30. The noise causing vibrations transmitted to the heater assembly 10 can be generated by any one of a number of household appliances, as for example, a refrigerator that usually is located in close proximity to the range. The refrigerator compressor has a frequency of approximately 60 CPS, while the natural resonance of frequency of the cooktop may be 30 CPS. However, it should be noted that the frequency of the heater may be in the 2,000 cy. range.

By the present invention, means are provided which eliminate the noise generally associated with these vibrations and further increase the efficiency of the heating element by providing insulation between the heating element 16 and its associated support structure. To this end, the heating unit assembly 10, including the heating element 16, grid 18 and support pan 20, are thermally isolated from the cooktop 12 by the use of resilient, thermally insulating isolating elements. In carrying out the present invention the resilient thermally insulating material employed was 304 stainless ASTM in a woven or spun state having a thickness of between 0.0625" and 0.125". The material may be obtained from several suppliers, one being METEX Co. under the item number DEV. 13712. It should be noted however that other materials may be available to accomplish the desired results. The resilient thermally insulating material used must also be immune to damage by acid and other materials and temperature of approximately 1400° F. that may be encountered during the cooking procedure. Since the vibrations are transmitted through the range it may be necessary to apply the isolating means at several points in the structure; however, it should be noted that the higher frequency vibrations, and accordingly the most objectionable, are those generated between the heating element 16 and the grid arms 30.

The resilient thermally insulating means employed includes a first resilient thermally insulating element 40 that, as shown in FIG. 2, is positioned between each pass or convolution of the heating element 16 and the point of contact on the upper edge portion of each of the arms 30. The element 40 in this position may be a thin strip having substantially the same dimension as the width of the arm 30, and may be secured to the arm by any suitable means such as an adhesive or by welding that can resist damage by the materials encountered during the cooking procedure and also the temperature attained by the heating element in the range mentioned above. This location of element 40 effectively isolates the heating element 16 from both vibration and heat transfer between the support grid 18 and unconnected convolutions of the heating element 16. The element 40 eliminates the longer duration higher frequency vibrations between the grid arms 30 and the heater element 16. The thickness of the elements 40 employed should be sufficient to dampen coil vibrations while not creating hot spots that are generally caused when heat is not dissipated.

The second resilient thermal element 42 is arranged at the point of contact between each of the grid arms 30 and the ledge 24 of pan 20. This location effectively isolates the grid support 18 and the heating element 16 from vibrations and a degree of heat loss between the pan 20 and support grid 18. A third resilient element 44 is in the form of a ring dimensioned to be interposed between the ring portion 22 of pan 20 and the surface 12. The arrangement of element 44 effectively isolates the heating unit assembly 10 which, as mentioned above, includes the heating element 16, the support grid 18 and the pan 20 from vibrations and a degree of heat loss between the assembly 10 and cooktop surface 12. It should be noted that the temperature in the area of ring portion 22 is substantially below the operating temperature of the heating unit and, accordingly, the material used for element 44 may take the form of a silicone. As noted above, most of the objectionable noise is generated by the higher frequency vibrations between the heater element 16 and its associated support. Since other heating unit configurations may present different methods of supporting the heating unit relative to the range and, accordingly, different paths of contact between the range and heating element 16, the exact positioning of the isolating elements may vary. However, it should be noted that the relatively loosely held heating element 16 should be isolated relative to its associated support in order to effectively eliminate the longer duration high frequency vibrations therebetween.

In summary, by the present invention, resilient thermal isolation has been provided between the heating unit 10 and the cooktop 12 at three points where vibration between juxtapositioned elements may result in objectionable noise levels.

The foregoing is a description of the preferred embodiment of the apparatus of the invention and it should be understood that variations may be made thereto without departing from the true spirit of the invention as defined in the appended claims.

What is claimed is:

1. An electric heating unit adapted to be mounted in an opening in a cooktop comprising:

a convoluted sheathed heating element, the convolutions of which are disposed in a single plane defining a cooking surface;

a support grid including a plurality of support arms being arranged vertically on edge, the heating element being supported on the upper edge in said single plane;

a grid support element arranged in said cooktop opening having means for supporting the outer end portions of said support arms and being supported by said cooktop;

holding means on the upper edge of at least one of said support arms securing at least one of said convolutions of said heating element to at least one of said support arms;

resilient thermal insulating pad means positioned on said upper edge of said support arms being interposed at the point of contact between said upper edge of said support arms and said heating element to cushion vibrations and to thermally insulate said heater element from said support frame.

2. The electric heating unit recited in claim 1 further including a resilient thermal insulating pad means interposed between the outer end portions of said support arms and said grid support element for cushioning vibrations and for thermally insulating said support grid from said grid support element.

3. An electric heating unit adapted to be mounted in an opening in a cooktop comprising:

a convoluted sheathed heating element, the convolutions of which are disposed in a single plane defining a cooking surface;

a pan means including a body portion dimensioned to be positioned in said cooktop opening, (a) a radially extending flange supported on said cooktop, and (b) a ledge portion formed in said body portion extending radially inwardly relative to said flange;

a support frame member including a plurality of support arms extending generally radially and being arranged vertically on edge with the outer end portion of said arms being supported on said ledge portion;

holding means on the upper edge of at least one of said support arms immovably securing the outer portion of said convoluted heating element to said one of said support arms, the heating element being supported on the upper edge in a single plane;

first resilient thermal insulating pad means positioned on said upper edge of said support arms being interposed at the point of contact between said upper edge of said support arms and said heating welement to cushion vibrations and to thermally insulate said heater element from said support frame.

4. The electric cooktop heating unit recited in claim 3 further including a second resilient thermal insulating pad means interposed between said outer end portion of said support arms and said ledge portion of said pan to cushion vibrations and to thermally insulate said support arm from said pan means.

5. The electric heating unit recited in claim 4 further including a third resilient thermal insulating pad means interposed between said radially extending flange and said cooktop for cushioning vibrations and for thermally insulating said support grid from said grid support element.

* * * * *